United States Patent [19]

Jackson

[11] 4,245,449

[45] Jan. 20, 1981

[54] TRUSS EMPLOYING BOTH METALLIC AND NON-METALLIC WEBS

[75] Inventor: Thomas E. Jackson, Woodland, Calif.

[73] Assignee: Steel Web Corporation, Alta Loma, Calif.

[21] Appl. No.: 13,328

[22] Filed: Feb. 21, 1979

[51] Int. Cl.[3] ..... E04B 1/32

[52] U.S. Cl. ..... 52/639; 52/693; 52/90

[58] Field of Search ..... 52/639, 657, 693, 696, 52/697, 642, 90, 695

[56] References Cited

U.S. PATENT DOCUMENTS

| | | | |
|---|---|---|---|
| 146,114 | 12/1873 | Weimer | 52/639 |
| 1,663,487 | 3/1928 | Smith | 52/695 |
| 3,345,792 | 10/1967 | Chandler | 52/693 |
| 3,531,904 | 10/1970 | Sanford | 52/642 |
| 3,748,809 | 7/1973 | Jackson | 52/693 |

FOREIGN PATENT DOCUMENTS

| | | | |
|---|---|---|---|
| 77425 | 7/1919 | Austria | 52/90 |
| 37012 | 6/1954 | Poland | 52/639 |
| 23268 | of 1913 | United Kingdom | 52/639 |

*Primary Examiner*—Price C. Faw, Jr.
*Assistant Examiner*—Henry E. Raduazo
*Attorney, Agent, or Firm*—Cushman, Darby & Cushman

[57] ABSTRACT

A roof truss incorporates both metallic and non-metallic webs, in special locations to optimize truss performance.

12 Claims, 5 Drawing Figures

TRUSS EMPLOYING BOTH METALLIC AND NON-METALLIC WEBS

BACKGROUND OF THE INVENTION

This invention relates generally to the construction of lightweight trusses adapted for use in mobile homes and similar environments. More specifically, the invention concerns simplifications and economies in the construction and fabrication of such trusses.

Prior to this invention, trusses and trussed joists of the type referred to were constructed of all wooden members, or with diagonal metallic webs between wooden blocks connecting upper and lower chord members.

No way was known to construct a less expensive yet satisfactory truss using both wooden and metallic diagonal webs to achieve economies and simplifications in truss construction, and in the manner to be described.

SUMMARY OF THE INVENTION

It has been discovered or found that the diagonal web members within a typical mono-pitched truss of the character to be described carry sufficiently less forces in the panels or zones further from the high end of the truss as to enable use of wooden diagonal webs placed in directions to carry compression loads in any panel except the first, with respect to the high end of the truss. The use of a wooden web in the first panel is not satisfactory because that web under load conditions would separate the bottom chord from the first vertical block without the use of a gusset; however, use of a gusset at that location is not compatible to a system using steel webs because all the connectors in such a system are applied in a "through-chord" direction. Also, the use of some wooden webs has a cost advantage in that they can be constructed or fabricated from broken chord material that would normally be scrapped. Also, wooden webs can carry more inverse or uplift loads than the steel webs which at times must be crossed to meet the uplift requirement.

Basically, then, the invention is embodied in the combination that comprises:

(a) upper and lower chord members extending in generally the same longitudinal direction and in spaced apart relation, (b) means connected to said upper and lower chord members and including multiple upright blocks which are longitudinally spaced apart along the lengths of said chord members and located therebetween, the vertical dimensions of said blocks decreasing between high and low ends of the truss, (c) said means including multiple load carrying webs in spaces between the blocks, each web extending diagonally between said chord members, (d) said webs including a metallic web extending between two blocks closest the high end of the truss, and a non-metallic web located between two blocks each of which is spaced from the block closest to said high end of the truss.

As will be seen, there are typically at least three blocks of sequentially decreasing vertical dimensions, the metallic web located between the first and second blocks and the non-metallic web located between the second and third blocks; the metallic web also extends between the high end of the first block and the low end of the second block; in one form of the invention the wooden web extends between the low end of the second block and the high end of the third block; and in another form of the invention the wooden web extends between the low end of the second block and upper chord member at a location between the second and third blocks, and another metallic web extends between that location and the low end of the third block.

Additional features of the invention include the stapling of the chord members to the wooden and metallic diagonal webs in the manner to be described and enabling rapid fabrication of the truss, and the locations and shaping of the ends of the webs to best facilitate staple connections.

These and other objects and advantages of the invention, as well as the details of illustrative embodiments, will be more fully understood from the following description and drawings, in which:

DRAWING DESCRIPTION

FIG. 1 is a side elevation of a truss incorporating the invention;

FIG. 1*a* is an enlarged fragmentary view of a connection shown in FIG. 1;

FIG. 1*b* is an enlarged fragmentary view of a modified connection;

FIG. 2 is a side elevation of a modified truss incorporating the invention; and FIG. 2*a* is an enlarged fragmentary view of a connection shown in FIG. 2.

DETAILED DESCRIPTION

Figures 1, 1A, 1B, 2, 2A:
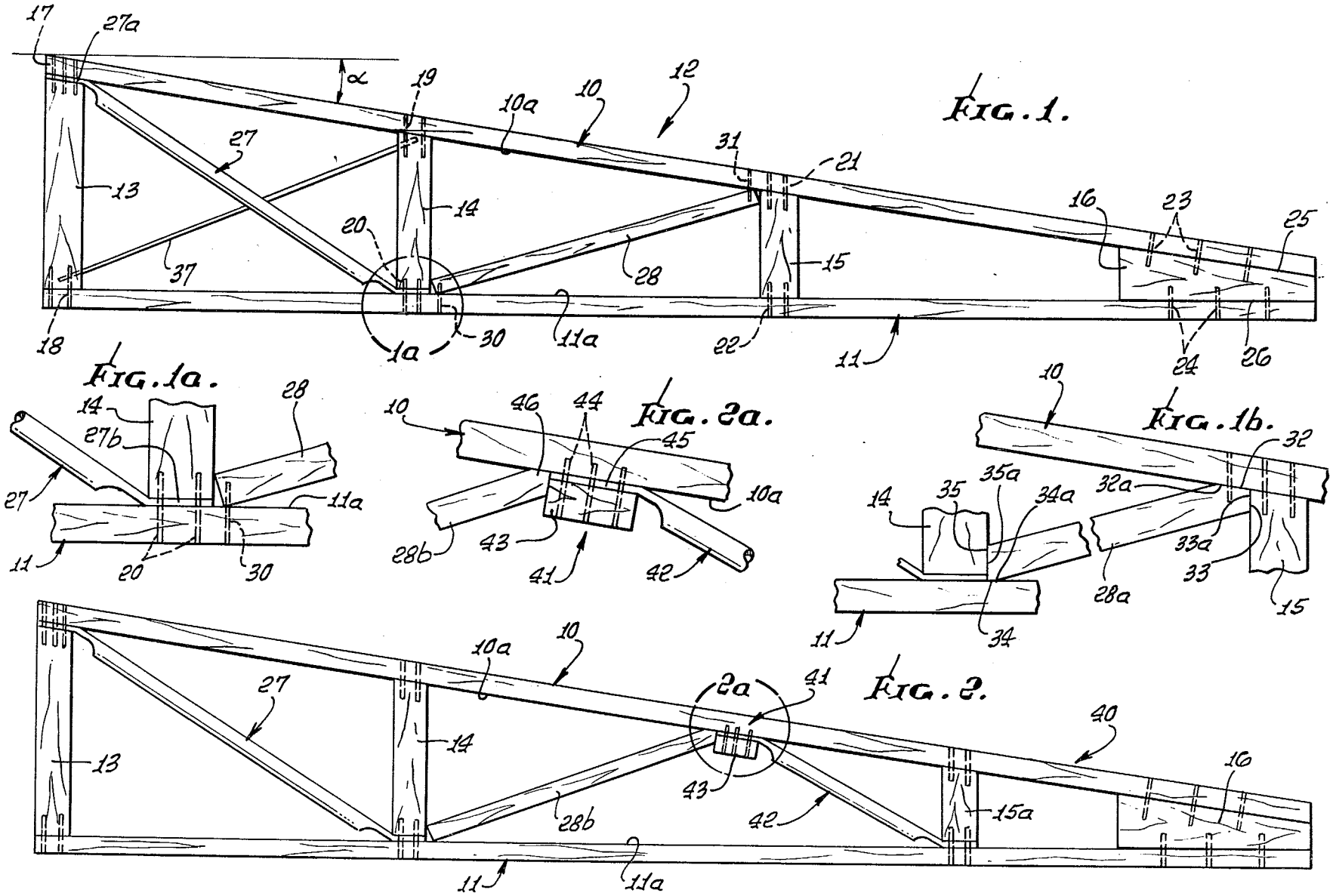

FIG. 1 shows upper and lower longitudinally elongated chord members 10 and 11 extending in the same generally horizontal direction and spaced apart vertically. Member 10 also typically extends at an angle $\alpha$ from horizontal. Such members may advantageously consist of wood, and they have inner sides at 10*a* and 11*a*.

Means is provided to interconnect the members 10 and 11, such means typically including non-metallic (as for example wooden) upright blocks which are longitudinally spaced apart and located between members 10 and 11. The vertical dimensions of the blocks decrease between the high and low ends of the truss 12, as represented by the first through fourth blocks 13–16. Fasteners such as staples, nails, etc., (but preferably staples) connect the chords to the blocks, as represented at 17–24. In addition, block 16 may be glued to the chord members inner sides 10*a* and 11*a*, at loci 25 and 26.

The means connected to the upper and lower chord members also includes multiple load carrying webs located in the spaces between the blocks, such webs extending diagonally between the chord members. Further, such webs include a metallic web (at 27 for example) located between two blocks (see first and second blocks 13 and 14 for example) closest the high end of the truss, and a non-metallic web (at 28 for example) located between two blocks (see second and third blocks 14 and 15, for example) each of which is spaced from the block closest to the high end of the truss. Block 13 is representative of a block closer to the high end of the truss than second and third blocks 14 and 15. The web 27 may consist of steel and have flat ends 27*a* and 27*b* and tubular or nonflat cross sections between such ends. End 27*a* fits between block 13 and chord 10, and end 27*b* fits between block 14 and chord 11, with the staples 17 and 20 penetrating such ends.

Web 28 advantageously consists of wood, so as to be less expensive than web 27; at the same time, it offers sufficient load carrying capacity. Web 28 extends between the low end of second block 14 and the high end of third block 15. The opposite ends of wooden web 28 are squared off so that end edges of the web engage and receive or transmit loading from (or to) the blocks and chord members as shown. Staples 30 and 31 attach the chord members to end portions of the web 28. FIG. 1*b* shows an alternative construction wherein the modified wood web 28*a* (corresponding to web 28) has opposite ends, each of which has tapered faces 32 and 33, and 34 and 35. The latter flatly engage the corners defined by surfaces 32*a* and 33*a*, and 34*a* and 35*a* of the blocks 15 and 14, as shown, for load transmission and reception.

FIG. 1 also shows another metallic web 37 extending diagonally between the chord members, and between the lower end portion of block 13 and the high end portion of block 14. Fasteners 18 and 19 pass through opposite ends of that web 37 that penetrate into the blocks, as shown. Web 37 offers additional load carrying capacity to the truss.

Referring to the modified truss 40 of FIG. 2, the elements thereof which are the same as for truss 12 of FIG. 1 bear the same numerals. Modified block 15*a* is spaced closer to block 16, leaving a larger gap or space between blocks 14 and 15*a* than between blocks 14 and 15 in FIG. 1.

The non-metallic, i.e. wooden web 28*b* is shorter than its FIG. 1 counterpart 28, and extends between the low end of second block 14 and the upper chord member at a location 41 between the blocks 14 and 15*a*. An additional metallic web 42 extends between the upper chord member at location 41 and the low end of the third block 15*a*. An additional wooden block 43 (also seen in FIG. 2*a*) is attached as by staples 44 to the upper chord member, but not to the lower chord member; and the block 43 is operatively connected to the tapered end 46 of web 28*b* and to the flat end 45 of metallic web 42. That flat end fits between block 43 and the side 10*a* of chord member 10 at location 41.

In FIG. 1 another web like web 28 may be inserted between the low end of third block 15 and the underside of chord 10, in spaced relation to block 16, and in a manner similar to web 28*b* in FIG. 2.

I claim:

1. In a truss, the combination comprising (a) upper and lower chord members extending in generally the same longitudinal direction and in spaced apart relation, (b) means connected to said upper and lower chord members and including multiple upright blocks which are longitudinally spaced apart along the lengths of said chord members and located therebetween, the vertical dimensions of said blocks decreasing between high and low ends of the truss, (c) said means including multiple load carrying webs in spaces between the blocks, each web extending diagonally between said chord members, (d) said webs including a metallic web extending between two blocks closest the high end of the truss, and a non-metallic web located between two blocks each of which is spaced from the block closest to said high end of the truss, said metallic web having flat ends respectively confined between ends of said two blocks closest the high end of the truss and said chord members, one of the blocks having an end portion operatively connected to ends of the metallic web and of the non-metallic web, said ends located adjacent the side of the lower chord which faces the upper chord.

2. The combination of claim 1 wherein said blocks, chord members and non-metallic web consists of wood.

3. The combination of claim 1 wherein there are at least first, second and third of said blocks of sequentially decreasing vertical dimensions, the metallic web located between the first and second blocks, and the non-metallic web located between the second and third blocks.

4. The combination of claim 3 in which the metallic web extends between the high end of the first block and the low end of the second block.

5. The combination of claim 4 in which the non-metallic web extends between the low end of the second block and the high end of the third block.

6. The combination of claim 4 in which the non-metallic web extends between the low end of the second block and the upper chord member at a location between the second and third blocks.

7. The combination of claim 5 including another metallic web extending diagonally between the chord members and between the low end portion of the first block and the high end portion of the second block.

8. The combination of claim 2 wherein said wooden web has opposite ends each having tapered faces respectively engaging corner defining surfaces of a block and chord member.

9. The combination of claim 1 including fasteners connecting the chord members to the blocks, and the chord members to the webs.

10. The combination of claim 9 wherein said fasteners comprise staples.

11. The combination of claim 1 wherein the metallic web has flat ends confined between ends of said two blocks and said chord members.

12. In a truss, the combination comprising (a) upper and lower chord members extending in generally the same longitudinal direction and in spaced apart relation, (b) means connected to said upper and lower chord members and including multiple upright blocks which are longitudinally spaced apart along the lengths of said chord members and located therebetween, the vertical dimensions of said blocks decreasing between high and low ends of the truss, (c) said means including multiple load carrying webs in spaces between the blocks, each web extending diagonally between said chord members, (d) said webs including a metallic web extending between two blocks closest the high end of the truss, and a non-metallic web located between two blocks each of which is spaced from the block closest to said high end of the truss, (e) the non-metallic web extending between the low end of the second block and the upper chord member at a location between the second and third blocks, (f) said webs including an additional metallic web extending between the upper chord member at said location and the low end of the third clock, there being an additional block attached only to the upper chord member and operatively connected to the ends of the additional metallic web and of the non-metallic web at said location.

* * * * *